US012484704B2

(12) United States Patent
Park

(10) Patent No.: US 12,484,704 B2
(45) Date of Patent: Dec. 2, 2025

(54) AUTOMATIC VERTICALLY-MOVABLE FOLDABLE BED

(71) Applicant: SUNGWOO MEDITECH CO., LTD., Seongnam-si (KR)

(72) Inventor: Chung Hwa Park, Seongnam-si (KR)

(73) Assignee: SUNGWOO MEDITECH CO., LTD., Seongnam-si (KR)

( * ) Notice: Subject to any disclaimer, the term of this patent is extended or adjusted under 35 U.S.C. 154(b) by 84 days.

(21) Appl. No.: 18/440,978

(22) Filed: Feb. 14, 2024

(65) Prior Publication Data

US 2025/0040723 A1 Feb. 6, 2025

(30) Foreign Application Priority Data

Aug. 1, 2023 (KR) ..... 10-2023-0100526

(51) Int. Cl.

| | |
|---|---|
| ***A47C 19/12*** | (2006.01) |
| ***A47C 19/02*** | (2006.01) |
| ***A47C 19/04*** | (2006.01) |

(52) U.S. Cl.

CPC ..... *A47C 19/126* (2013.01); *A47C 19/024* (2013.01); *A47C 19/04* (2013.01)

(58) Field of Classification Search

CPC ..... A47C 19/126; A47C 19/024; A47C 19/04; A47C 19/02; A47C 19/12

USPC ..... 5/18.1, 20, 47, 81.1 HS, 146, 147, 158, 5/174, 224, 311

See application file for complete search history.

(56) References Cited

U.S. PATENT DOCUMENTS

| | | | | |
|---|---|---|---|---|
| 2,424,139 A * | 7/1947 | Bebry | ..... | A47C 17/22 5/31 |
| 6,588,837 B1 * | 7/2003 | Schultz | ..... | A47C 17/165 297/118 |
| 2016/0090181 A1 * | 3/2016 | Breuer | ..... | B64D 11/0641 5/20 |

FOREIGN PATENT DOCUMENTS

| | | | |
|---|---|---|---|
| KR | 20-0250599 | Y1 | 10/2001 |
| KR | 10-2003-0071738 | A | 9/2003 |
| KR | 10-2004-0076395 | A | 9/2004 |
| KR | 10-2012-0122265 | A | 11/2012 |
| KR | 10-1679584 | B1 | 11/2016 |
| KR | 10-1783017 | B1 | 10/2017 |
| KR | 10-2006603 | B1 | 8/2019 |
| KR | 10-2418220 | B1 | 7/2022 |

(Continued)

OTHER PUBLICATIONS

Korean Notice of Allowance for related KR Application No. 10-2023-0100526 mailed Oct. 10, 2023 from Korean Intellectual Property Office.

*Primary Examiner* — Justin V Lewis

(74) *Attorney, Agent, or Firm* — Paratus Law Group, PLLC

(57) ABSTRACT

An automatic vertically-movable foldable bed includes a body frame; a leg frame connected to one side of the body frame; a plurality of foldable legs having upper ends pivotably connected to the leg frame; an actuator connected to the upper ends of the foldable legs; a vertical movement guide provided at one side of the body frame and extending in a vertical direction; a first guide roller provided at a position of the leg frame corresponding to a position of the vertical movement guide; a sliding guide rail provided at each of both opposing sides of a bottom portion of the body frame; and a second guide roller provided at one end of the leg (Continued)

frame at a position thereof corresponding to a position of the sliding guide rail.

5 Claims, 10 Drawing Sheets

(56) References Cited

FOREIGN PATENT DOCUMENTS

KR 10-2022-0157029 A 11/2022

* cited by examiner

AUTOMATIC VERTICALLY-MOVABLE FOLDABLE BED

CROSS-REFERENCE TO RELATED APPLICATION

This application claims priority to Korean Patent Application No. 10-2023-0100526 (filed on Aug. 1, 2023), which is hereby incorporation by reference in its entirety.

BACKGROUND

The present disclosure relates to an automatic vertically-movable foldable bed, and more specifically, to a foldable bed in which space efficiency is improved when the bed is moving or not in use due to a foldable structure of the bed, and vertical movement may automatically performed for a folding operation.

Recently, as interest in health has increased, functional bed products with various treatment functions, thermal therapy with a heating function, massage with massage tools, or physical therapy, have been released.

Since each of these functional beds requires a length equivalent to a height of an adult, a frame thereof is manufactured to have a certain length and then transported to consumers or sales outlets.

However, a conventional treatment bed has an integrated structure. Thus, it is difficult to store and move the bed due to a space which the bed takes up during transportation or storage. Further, there are inconveniences such as taking up an indoor space even when the user does not use the bed.

RELATED ART

Korean Patent No. 1783017 registered on Sep. 22, 2017
Korean Patent No. 1679584 registered on Nov. 21, 2016

SUMMARY

The present disclosure is proposed to improve the problems in the prior art as described above. A purpose of the present disclosure is to provide a bed structure that is foldable and is stored in a folded state and can automatically perform vertical movement for the folding operation, thereby improving the convenience of use of a product including the bed, and making it easy to move and store the product.

Purposes according to the present disclosure are not limited to the above-mentioned purpose. Other purposes and advantages according to the present disclosure that are not mentioned may be understood based on following descriptions, and may be more clearly understood based on embodiments according to the present disclosure. Further, it will be easily understood that the purposes and advantages according to the present disclosure may be realized using means shown in the claims or combinations thereof.

The present disclosure provides an automatic vertically-movable foldable bed comprising: a body frame having a predefined height so as to support an upper body of a user; a leg frame connected to one side of the body frame and configured to support a lower body of a user; a plurality of foldable legs having upper ends pivotably connected to the leg frame such that the plurality of foldable legs are folded; an actuator connected to the upper ends of the foldable legs and configured to drive pivot movement of the plurality of foldable legs; a vertical movement guide provided at one side of the body frame and extending in a vertical direction so as to guide vertical movement of the leg frame; a first guide roller provided at a position of the leg frame corresponding to a position of the vertical movement guide, wherein vertical movement of the first guide roller is guided along the vertical movement guide; a sliding guide rail provided at each of both opposing sides of a bottom portion of the body frame so as to guide horizontal sliding movement of the leg frame; and a second guide roller provided at one end of the leg frame at a position thereof corresponding to a position of the sliding guide rail, wherein horizontal movement of the second guide roller is guided along the sliding guide rail.

In one embodiment of the automatic vertically-movable foldable bed, the first guide roller is connected to and supported on the leg frame via a support bracket having a U shape, wherein the first guide roller is pivotably connected to the support bracket via a pivot shaft.

In one embodiment of the automatic vertically-movable foldable bed, the plurality of foldable legs includes front two foldable legs and rear two foldable legs connected to each other via a connection frame at upper ends of the legs such that the front two foldable legs and the rear two foldable legs simultaneously pivot so as to be folded under an operation of the actuator.

In one embodiment of the automatic vertically-movable foldable bed, a shock absorbing pad is provided at an end of the sliding guide rail to absorb shock of the first guide roller when the leg frame is lowered down, wherein the shock absorbing pad is elastically supported on a shock absorbing spring, wherein the shock absorbing spring is formed in a pad groove formed in the sliding guide rail.

In one embodiment of the automatic vertically-movable foldable bed, the sliding guide rail is coated with a protective layer to reduce impact of the second guide roller when the leg frame is lowered down and to achieve smooth sliding movement, wherein the protective layer includes a mixture of polysulfone resin, sepiolite, epoxy vitrimer resin, potassium chromic acid, cobalt naphthenate phenylalanine, phenylalanine hydroxylase, polybenzimidazene, lithium hydroxide, isoflavonoid, polycaprolactone, and sodium fluoride.

The foldable bed of the present disclosure is capable of automatically lowering the leg frame such that the legs are pivotably folded, thereby improving convenience of use and making it easier to move and store the bed.

Effects of the present disclosure are not limited to the effects mentioned above, and other effects not mentioned will be clearly understood by those skilled in the art from the descriptions below.

DETAILED DESCRIPTIONS

Figure 1:
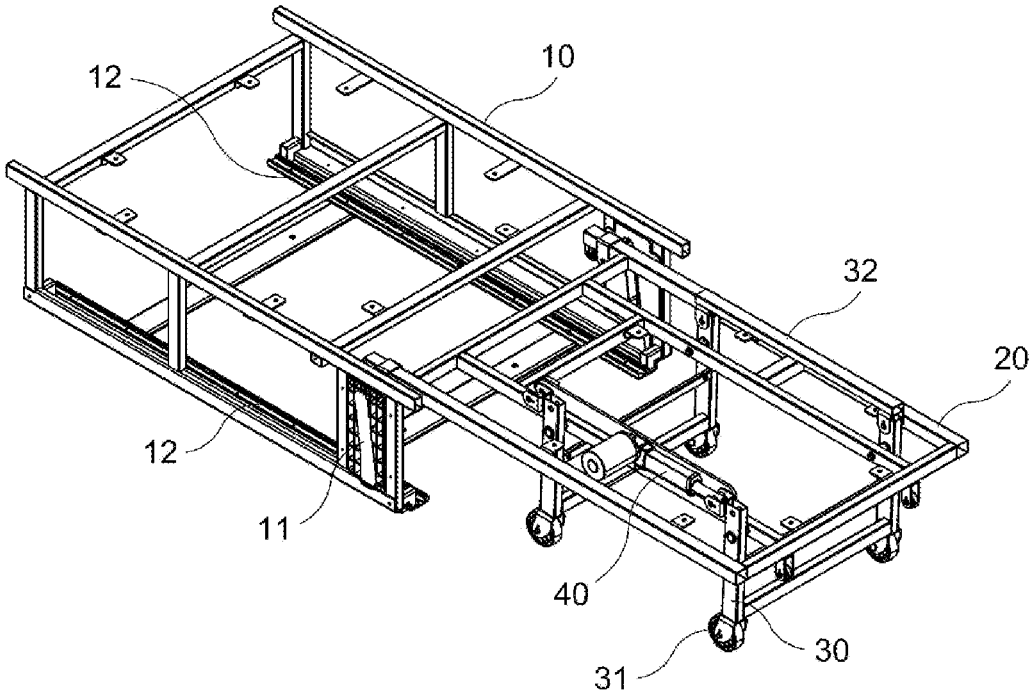
FIG. 1 and FIG. 2 are perspective views of a foldable bed frame according to an embodiment of the present disclosure.

Hereinafter, embodiments of the present disclosure will be described in detail with reference to the accompanying drawings. The present disclosure may have various changes and may have various forms. Thus, specific embodiments are illustrated in the drawings and described in detail herein. However, this is not intended to limit the present disclosure to a specific disclosure form. It should be understood that the present disclosure includes all changes, equivalents, or substitutes as included within the spirit and technical scope of the present disclosure. The embodiments are set forth only to make the present disclosure complete, and to entirely inform the scope of the present disclosure to those of ordinary skill in the technical field to which the present disclosure belongs, and the present disclosure is only defined by the scope of the claims.

For simplicity and clarity of illustration, elements in the drawings are not necessarily drawn to scale. The same reference numbers in different drawings represent the same or similar elements, and as such perform similar functionality. Further, descriptions and details of well-known steps and elements are omitted for simplicity of the description. Furthermore, in the following detailed description of the present disclosure, numerous specific details are set forth in order to provide a thorough understanding of the present disclosure. However, it will be understood that the present disclosure may be practiced without these specific details. In other instances, well-known methods, procedures, components, and circuits have not been described in detail so as not to unnecessarily obscure aspects of the present disclosure. Examples of various embodiments are illustrated and described further below. It will be understood that the description herein is not intended to limit the claims to the specific embodiments described. On the contrary, it is intended to cover alternatives, modifications, and equivalents as may be included within the spirit and scope of the present disclosure as defined by the appended claims.

A shape, a size, a ratio, an angle, a number, etc. disclosed in the drawings for illustrating embodiments of the present disclosure are illustrative, and an embodiment of embodiments of the present disclosure are not limited thereto.

The terminology used herein is directed to the purpose of describing particular embodiments only and is not intended to be limiting of the present disclosure. As used herein, the singular constitutes "a" and "an" are intended to include the plural constitutes as well, unless the context clearly indicates otherwise. It will be further understood that the terms "comprise", "comprising", "include", and "including" when used in this specification, specify the presence of the stated features, integers, operations, elements, and/or components, but do not preclude the presence or addition of one or more other features, integers, operations, elements, components, and/or portions thereof. As used herein, the term "and/or" includes any and all combinations of one or more of associated listed items. Expression such as "at least one of" when preceding a list of elements may modify the entire list of elements and may not modify the individual elements of the list. In interpretation of numerical values, an error or tolerance therein may occur even when there is no explicit description thereof.

It will also be understood that when a first element or layer is referred to as being present "on" a second element or layer, the first element may be disposed directly on the second element or may be disposed indirectly on the second element with a third element or layer being disposed between the first and second elements or layers. It will also be understood that when a first element or layer is referred to as being present "under" a second element or layer, the first element may be disposed directly under the second element or may be disposed indirectly under the second element with a third element or layer being disposed between the first and second elements or layers.

It will be understood that when an element or layer is referred to as being "connected to", or "coupled to" another element or layer, it may be directly connected to or coupled to another element or layer, or one or more intervening elements or layers therebetween may be present. In addition, it will also be understood that when an element or layer is referred to as being "between" two elements or layers, it may be the only element or layer between the two elements or layers, or one or more intervening elements or layers therebetween may also be present.

In addition, it will also be understood that when an element or layer is referred to as being "between" two elements or layers, it may be the only element or layer between the two elements or layers, or one or more intervening elements or layers therebetween may also be present.

Further, as used herein, when a layer, film, region, plate, or the like is disposed "on" or "on a top" of another layer, film, region, plate, or the like, the former may directly contact the latter or still another layer, film, region, plate, or the like may be disposed between the former and the latter. As used herein, when a layer, film, region, plate, or the like is directly disposed "on" or "on a top" of another layer, film, region, plate, or the like, the former directly contacts the latter and still another layer, film, region, plate, or the like is not disposed between the former and the latter.

Further, as used herein, when a layer, film, region, plate, or the like is disposed "below" or "under" another layer, film, region, plate, or the like, the former may directly contact the latter or still another layer, film, region, plate, or the like may be disposed between the former and the latter. As used herein, when a layer, film, region, plate, or the like is directly disposed "below" or "under" another layer, film, region, plate, or the like, the former directly contacts the latter and still another layer, film, region, plate, or the like is not disposed between the former and the latter.

When a certain embodiment may be implemented differently, a function or an operation specified in a specific block may occur in a different order from an order specified in a flowchart. For example, two blocks in succession may be actually performed substantially concurrently, or the two blocks may be performed in a reverse order depending on a function or operation involved.

It will be understood that, although the terms "first", "second", "third", and so on may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described under could be termed a second element, component, region, layer or section, without departing from the spirit and scope of the present disclosure.

Spatially relative terms, such as "beneath," "below," "lower," "under," "above," "upper," and the like, may be used herein for ease of illustration to illustrate one element or feature's relationship to another element or feature as illustrated in the figures. It will be understood that the spatially relative terms are intended to encompass different orientations of the device in use or in operation, in addition to the orientation depicted in the figures. For example, when the device in the drawings may be turned over, elements described as "below" or "beneath" or "under" other elements or features would then be oriented "above" the other elements or features. Thus, the example terms "below" and "under" may encompass both an orientation of above and below. The device may be otherwise oriented, for example, rotated 90 degrees or at other orientations, and the spatially relative descriptors used herein should be interpreted accordingly.

The features of the various embodiments of the present disclosure may be partially or entirely combined with each other, and may be technically associated with each other or operate with each other. The embodiments may be implemented independently of each other and may be implemented together in an association relationship.

Unless otherwise defined, all terms including technical and scientific terms used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The terms used in the description below have been selected as being general and universal in the related technical field. However, there may be other terms than the terms depending on the development and/or change of technology, convention, preference of technicians, etc. Therefore, the terms used in the description below should not be understood as limiting technical ideas, but should be understood as examples of the terms for illustrating embodiments.

Further, in a specific case, a term may be arbitrarily selected by the applicant, and in this case, the detailed meaning thereof will be described in a corresponding description section. Therefore, the terms used in the description below should be understood based on not simply the name of the terms, but the meaning of the terms and the contents throughout the Detailed Descriptions.

First, an automatic vertically-movable foldable bed structure according to an embodiment of the present disclosure is described below with reference to FIGS. 1 to 13.

Figure 2:
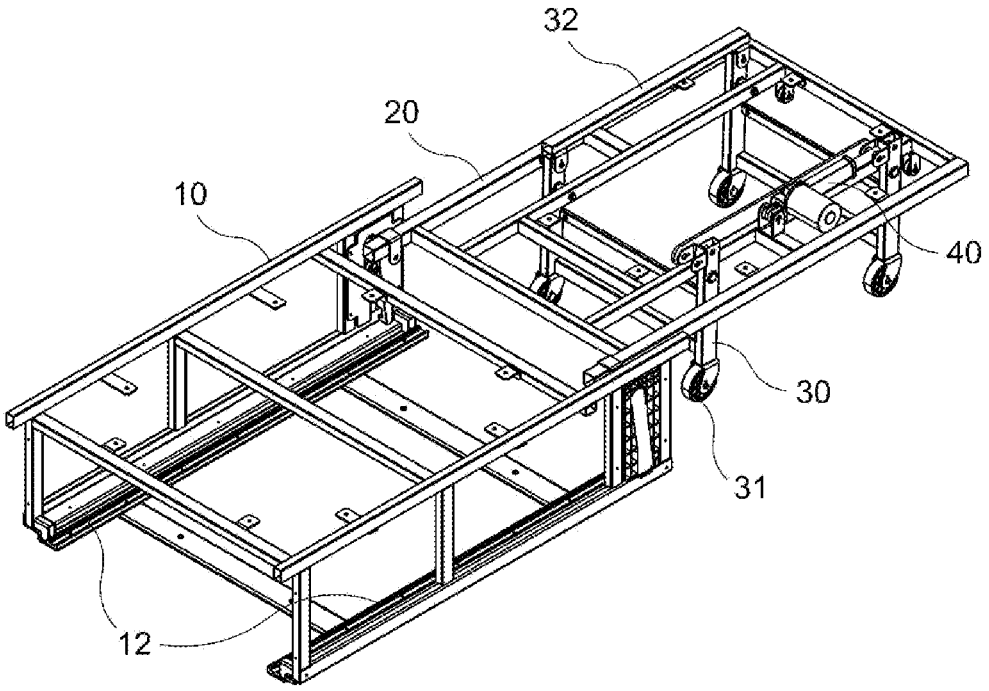
Figure 3:
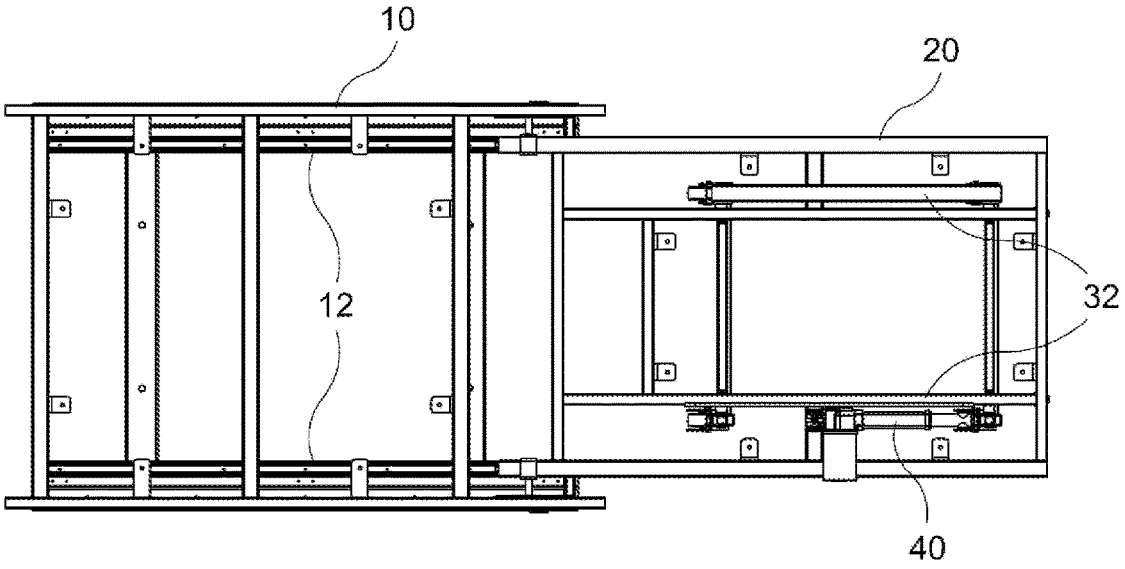
FIG. 3 is a plan view of a foldable bed frame according to an embodiment of the present disclosure.
Figure 4:
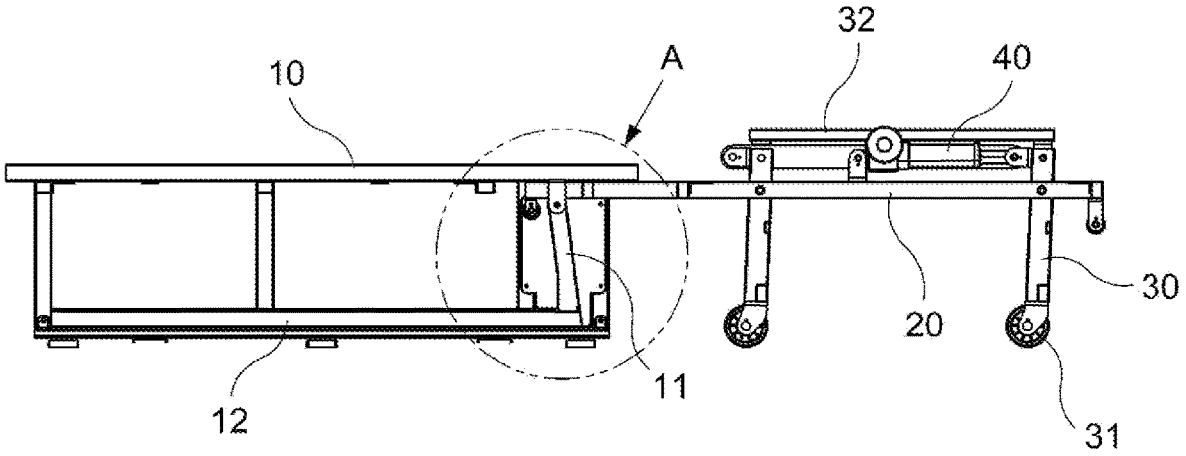
FIG. 4 is a side view of a foldable bed frame according to an embodiment of the present disclosure.
Figure 5:
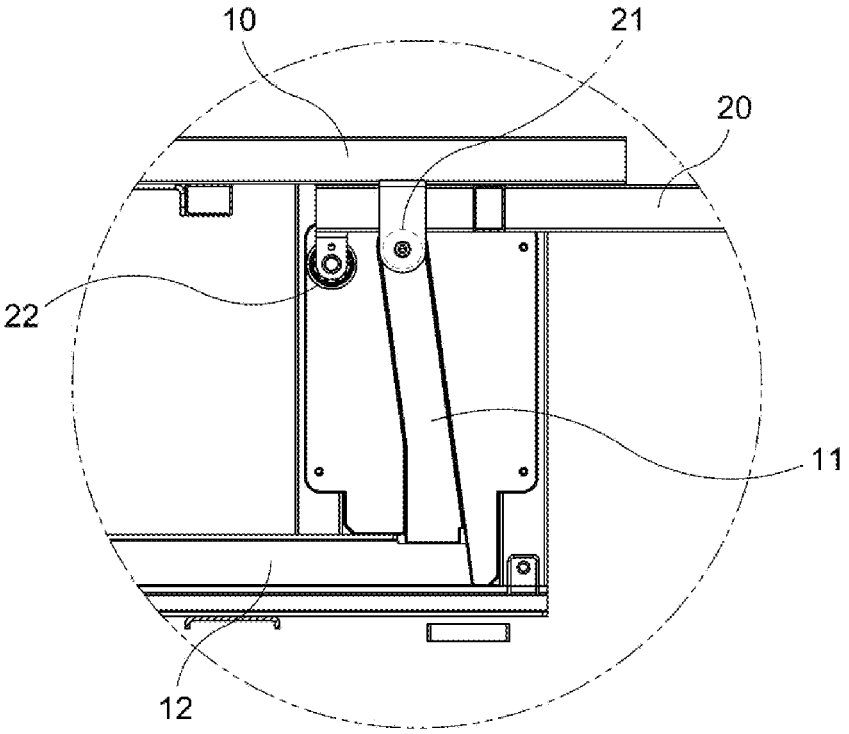
FIG. 5 is an enlarged view of a portion A of FIG. 4.
Figure 6:
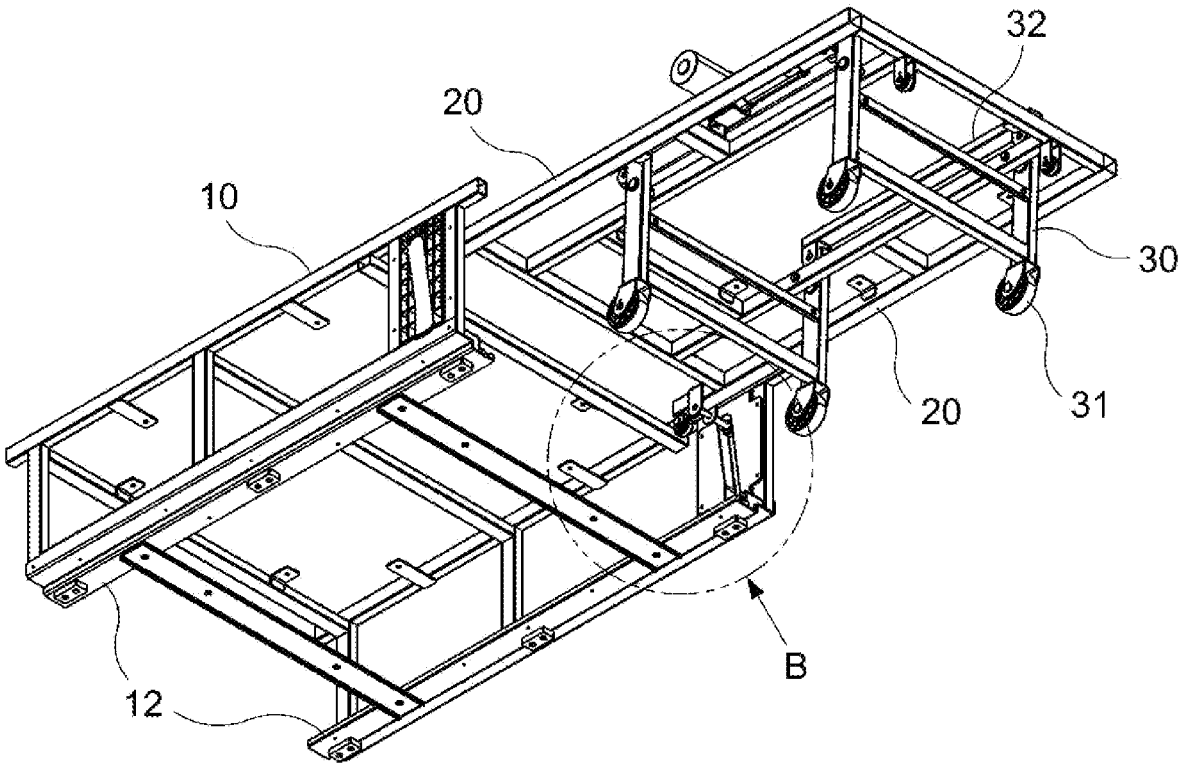
FIG. 6 is a bottom perspective view of a foldable bed frame according to an embodiment of the present disclosure.
Figure 7:
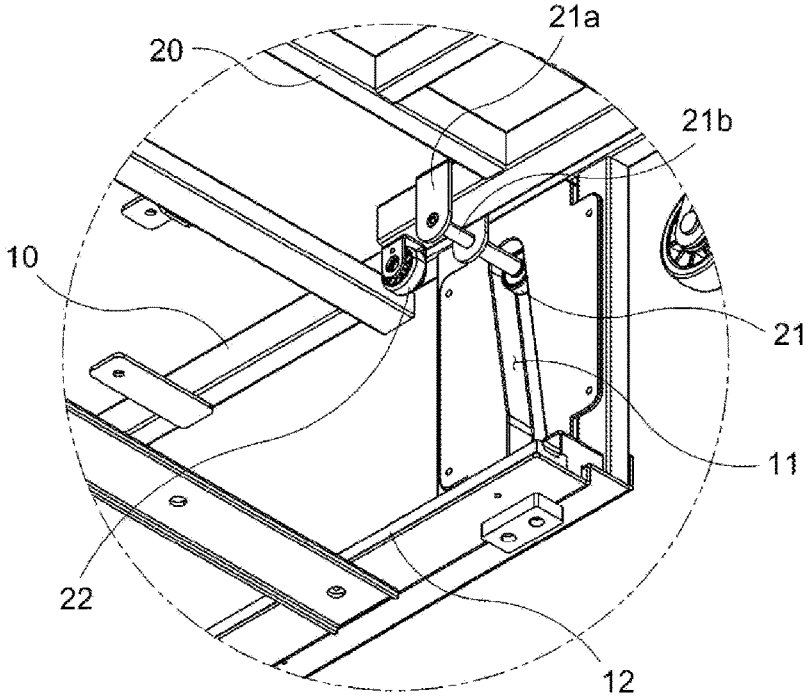
FIG. 7 is an enlarged view of a portion B of FIG. 6.
Figure 8:
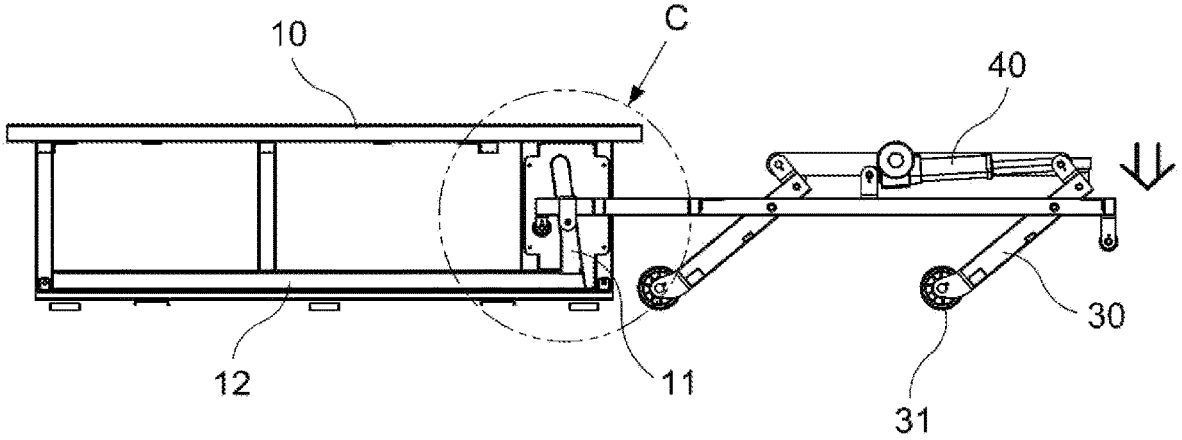
FIG. 8 is a side view of a state in which a foldable bed frame according to an embodiment of the present disclosure is being folded downwardly.
Figure 9:
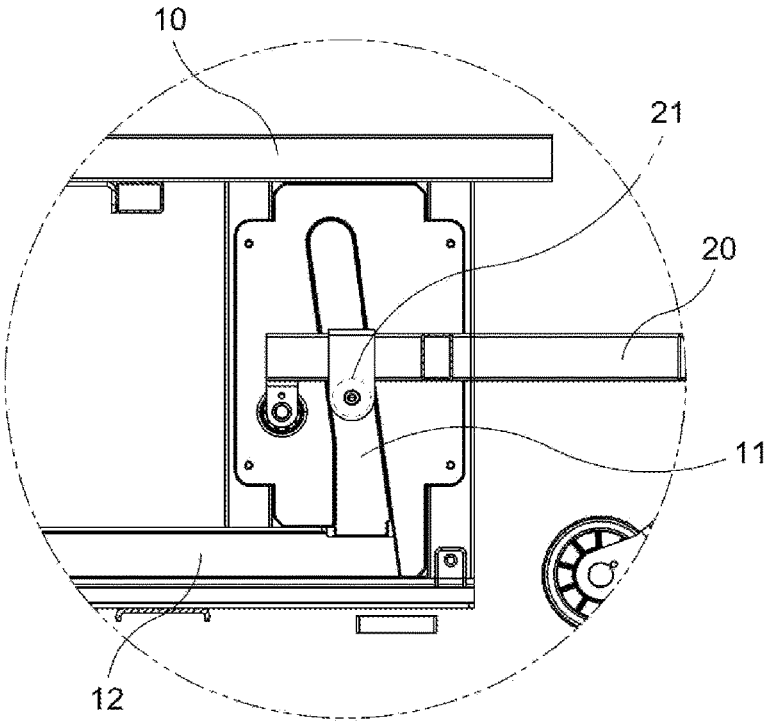
FIG. 9 is an enlarged view of a portion C of FIG. 8.
Figure 10:
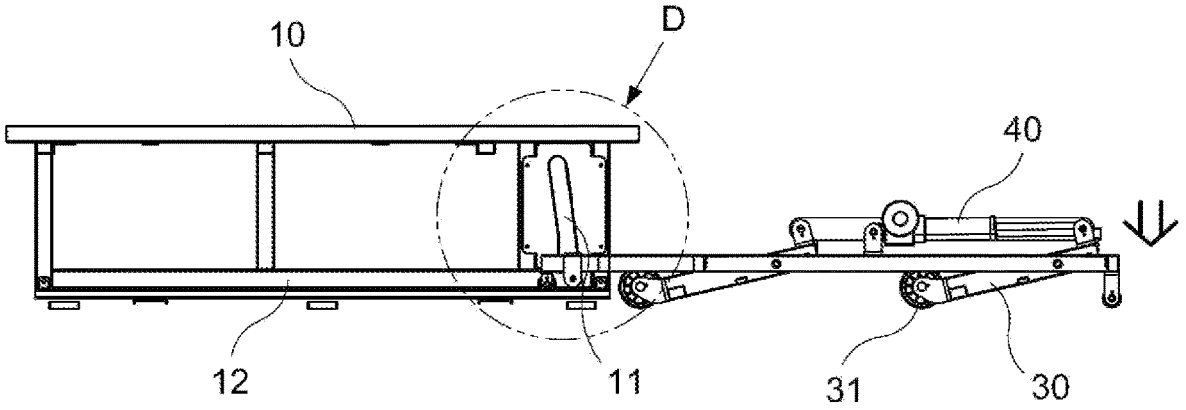
FIG. 10 is a side view of a state in which a foldable bed frame according to an embodiment of the present disclosure has been fully folded downwardly.
Figure 11:
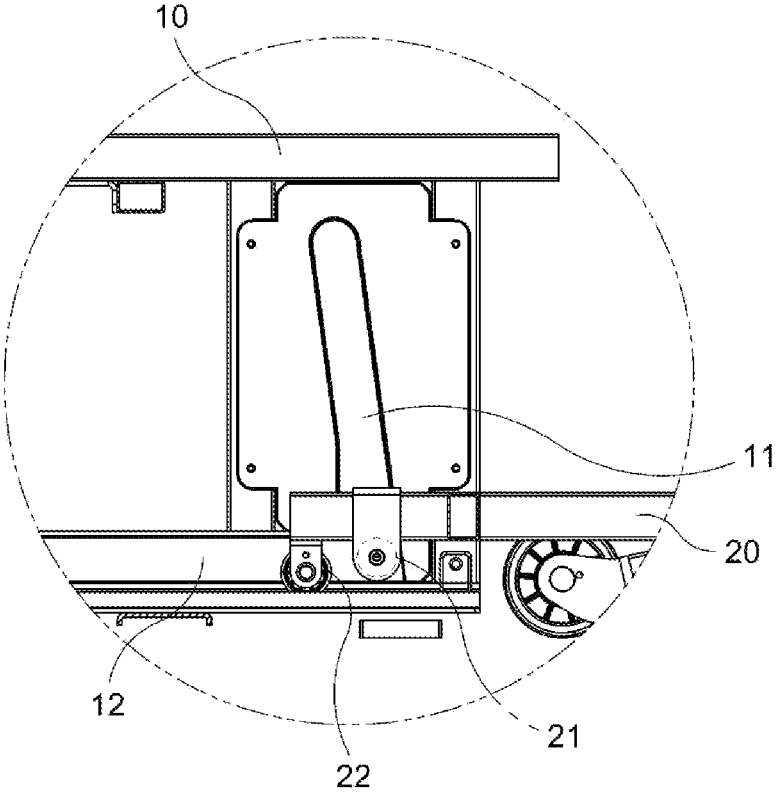
FIG. 11 is an enlarged view of a portion D of FIG. 10.
Figure 12:
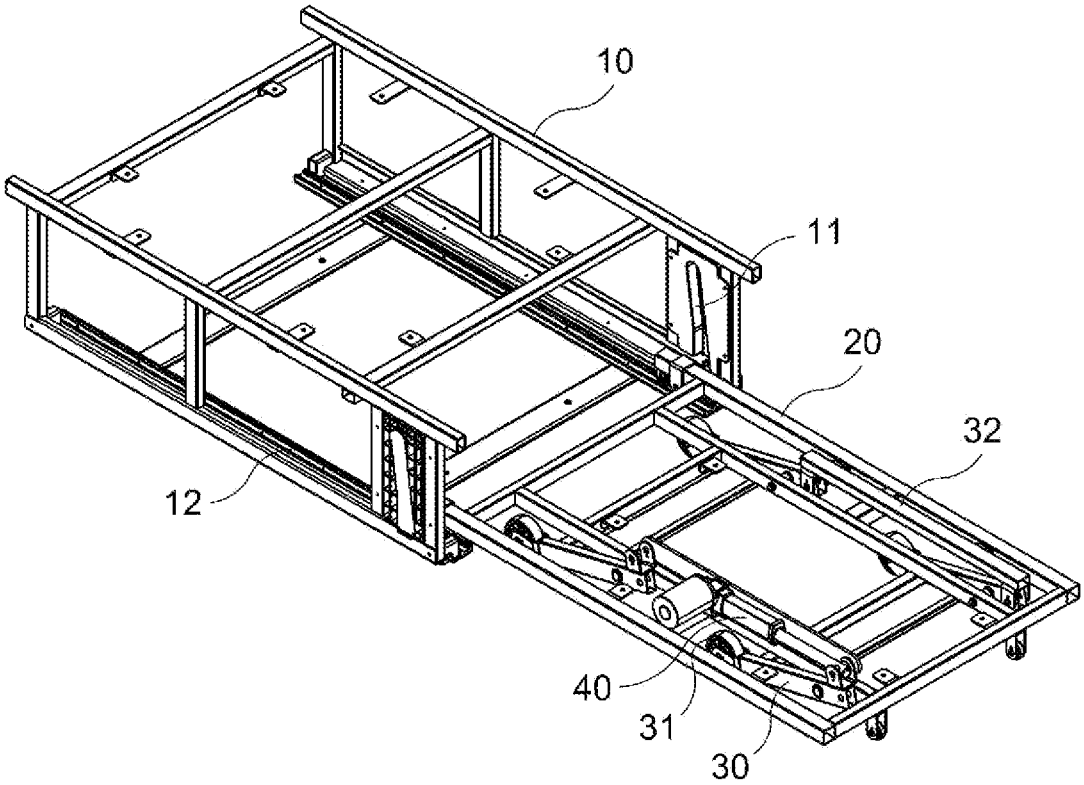
FIG. 12 is a perspective view of a state in which a foldable bed frame according to an embodiment of the present disclosure has been fully folded downwardly.
Figure 13:
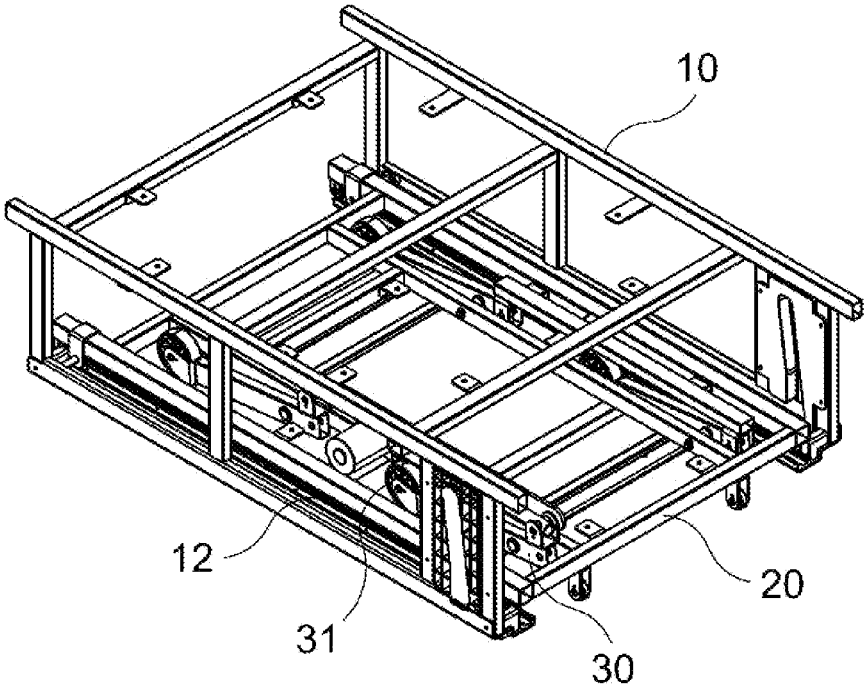
FIG. 13 is a perspective view of a state in which a foldable bed frame according to an embodiment of the present disclosure is in a fully retracted state in a fully folded state.

FIG. 1 and FIG. 2 are perspective views of a foldable bed frame according to an embodiment of the present disclosure. FIG. 3 is a plan view of a foldable bed frame according to an embodiment of the present disclosure. FIG. 4 is a side view of a foldable bed frame according to an embodiment of the present disclosure. FIG. 5 is an enlarged view of a portion A of FIG. 4. FIG. 6 is a bottom perspective view of a foldable bed frame according to an embodiment of the present disclosure. FIG. 7 is an enlarged view of a portion B of FIG. 6. FIG. 8 is a side view of a state in which a foldable bed frame according to an embodiment of the present disclosure is being folded downwardly. FIG. 9 is an enlarged view of a portion C of FIG. 8. FIG. 10 is a side view of a state in which a foldable bed frame according to an embodiment of the present disclosure has been fully folded downwardly. FIG. 11 is an enlarged view of a portion D of FIG. 10. FIG. 12 is a perspective view of a state in which a foldable bed frame according to an embodiment of the present disclosure has been fully folded downwardly. FIG. 13 is a perspective view of a state in which a foldable bed frame according to an embodiment of the present disclosure is in a fully retracted state in a fully folded state.

The foldable bed according to the present embodiment includes a body frame 10 having a certain height to support the user's upper body, and a leg frame 20 connected to one side of the body frame 10 to support the user's lower body, and a plurality of foldable legs 30 respectively having upper ends pivotably connected to the leg frame 20 so as to be foldable, and an actuator 40 connected to the tops thereof to drive a pivot movement of the foldable legs 30.

In this regard, a vertical movement guide 11 is provided at one side of the body frame 10 and extends in a vertical direction to guide the vertical movement of the leg frame 20. The leg frame 20 has a first guide roller 21 such that vertical movement of the first guide roller 21 is guided along the vertical movement guide 11.

A sliding guide rail 12 is provided at each of both opposing sides of a bottom portion of the body frame 10 to guide horizontal sliding of the leg frame 20 such that the leg frame 20 extends or retracts from the body frame 10. A second guide roller 22 is provided at one end of the leg frame 20 so that horizontal movement of the second guide roller 22 is guided along the sliding guide rail 12.

Furthermore, the first guide roller 21 is connected to and supported on the leg frame 20 via a support bracket 21*a* having a "U" shape. The first guide roller 21 is pivotably connected to the support bracket 21*a* via a pivot shaft 21*b*.

Furthermore, the front two foldable legs 30 and the rear two foldable legs 30 are connected to each other via a connection frame 32 at upper ends of the legs. Thus, the front two foldable legs 30 and the rear two foldable legs 30 simultaneously pivots around the pivot shafts so as to be folded under an operation of the actuator 40.

An operation of the automatic vertically-movable foldable bed according to present disclosure which has the above configuration, and an effect thereof will be described below.

The bed in accordance with the present disclosure may be used for various purposes such as thermal therapy, massage, or physical therapy. The leg frame 20 that supports the lower body of the user is connected to at one side of the body frame 10 that supports the upper body of the user in a vertically movable manner and in a slidable and foldable manner.

FIGS. 1 to 7 show a state in which the leg frame 20 is raised up so as to be positioned at the same vertical level as that of the body frame 10. In this state, when a folding operation is to be performed for transport or storage of the bed, first the leg frame 20 is lowered down.

That is, at this time, when the foldable leg 30 is folded in a pivoting manner under the operation of the actuator 40, the leg frame 20 is gradually lowered down as shown in FIG. 8 and FIG. 9. At this time, the first guide roller 21 provided at one side of the leg frame 20 descends while being guided by the vertical movement guide 11. Thus, the leg frame 20 is lowered down while the leg frame 20 maintains a stable horizontal state.

In particular, in this lowering operation process, when the actuator 40 operates, the four foldable legs 30 are folded in the pivoting manner at the same time while being connected to each other via the connection frame 32.

Then, when the lowering operation has been completed, the state shown in FIG. 10 to FIG. 12 is achieved. In this case, the second guide roller 22 formed at the end of the leg frame 20 is seated on the sliding guide rail 12.

Figure 14:
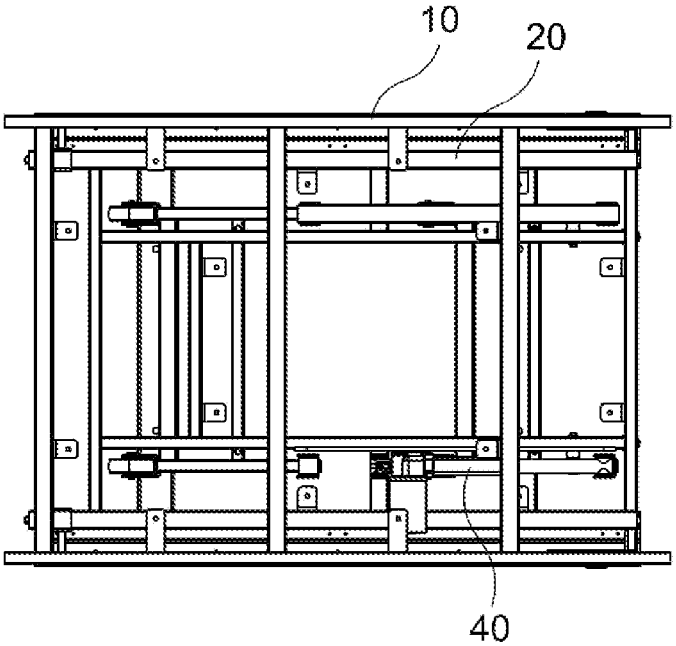
FIG. 14 is a plan view of a state in which a foldable bed frame according to an embodiment of the present disclosure is in a fully retracted state in a fully folded state.
Figure 15:
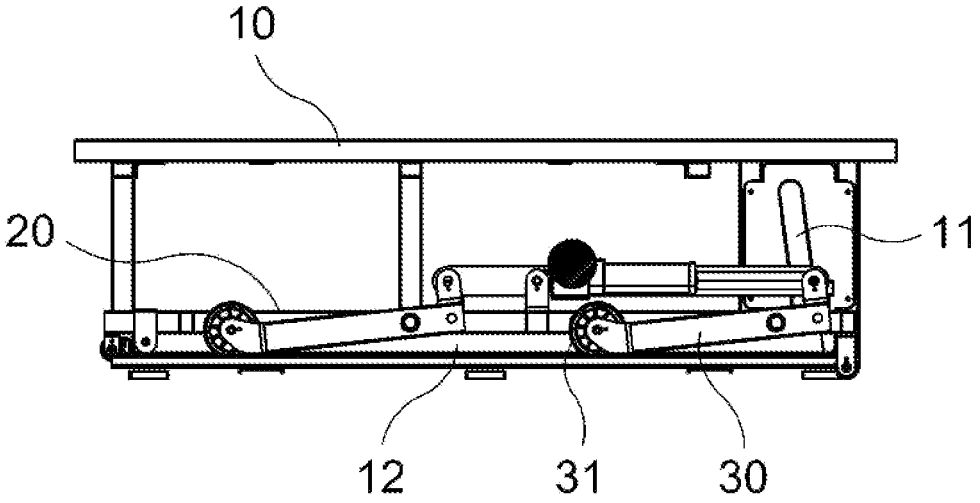
FIG. 15 is a side view of a state in which a foldable bed frame according to an embodiment of the present disclosure is in a fully retracted state in a fully folded state.

In this state, when the user applies a force to retract the leg frame 20 into the body frame 10, the horizontal movement of the second guide roller 22 is guided along the sliding guide rail 12 such that the leg frame 20 retracts into the body frame 10, ultimately achieving a storage state as shown in FIGS. 13 to 15.

In order to use the bed, in the opposite order to the direction as described above, the user may extend the leg frame 20 out of the body frame 10 and operate the actuator 40, so that the leg frame 20 gradually rises up and returns to its original state.

Therefore, the foldable bed according to the present disclosure is capable of automatically lowering the leg frame such that the legs are folded in a pivoting manner, thereby improving convenience of use and making it easier to move and store the bed.

Figure 16:
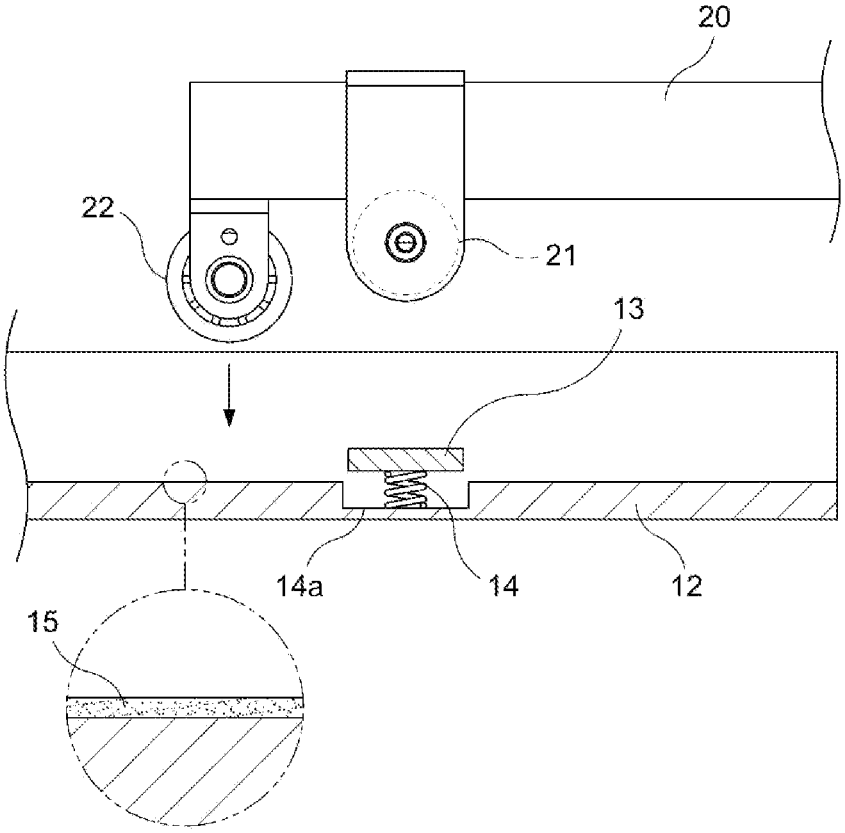
FIG. 16 is a cross-sectional structural diagram of a main part according to another example of the present disclosure.

FIG. 16 shows a configuration according to another embodiment of the present disclosure, wherein a shock absorbing pad 13 is provided at an end of the sliding guide rail 12 formed at the body frame 10 to absorb a shock affected by the first guide roller 21 when the leg frame 20 is lowered. The shock absorbing pad 13 is elastically supported on a shock absorbing spring 14. The shock absorbing spring 14 is formed in a pad groove 14*a* formed in the sliding guide rail 12. Furthermore, the sliding guide rail 12 is coated with a protective layer 15 to reduce the impact of the second guide roller 22 when the leg frame 20 is lowered and to ensure smooth sliding movement of the second guide roller 22.

In this regard, the protective layer 15 may be made of a mixture of 20 to 40% by weight of polysulfone resin, 1 to 10% by weight of sepiolite, 10 to 30% by weight of epoxy vitrimer resin, 5 to 20% by weight of potassium chromic acid, 5 to 10% by weight of cobalt naphthenate phenylalanine, 1 to 10% by weight of phenylalanine hydroxylase, 1 to 5% by weight of polybenzimidazene, 5 to 10% by weight of lithium hydroxide, 1 to 10% by weight of isoflavonoid, 1 to 10% by weight of polycaprolactone, and 1 to 10% by weight of sodium fluoride.

The above configuration may reduce shock and noise generation in the leg frame 20 due to the shock absorbing pad 13 and the protective layer 15 during the lowering operation of the leg frame 20.

That is, the first guide roller 21 is cushioned and supported by the shock absorbing pad 13, which is supported by the shock absorbing spring 14, such that sudden shock occurrence during the lowering process can be prevented. Further, the contact noise of the second guide roller 21 can be reduced by the protection layer 15.

In particular, since the protective layer 15 contains sepiolite, coating durability can be improved. The potassium chromic acid and cobalt naphthenate can prevent agglomeration during the coating process via the catalytic function of the polysulfone resin. The phenylalanine hydroxylase functions to prevent discoloration and whitening of the protective layer 15. The polybenzimidazene and lithium hydroxide function to increase coating density. Furthermore, the isoflavonoid improve coating lubricity. The polycaprolactone and sodium fluoride improves the elasticity of the protective layer 15 and perform the function of preventing cracks from occurring, respectively.

Although embodiments of the present disclosure have been described with reference to the accompanying drawings, embodiments of the present disclosure are not limited to the above embodiments, but may be implemented in various different forms. A person skilled in the art may appreciate that the present disclosure may be practiced in other concrete forms without changing the technical spirit or essential characteristics of the present disclosure. Therefore, it should be appreciated that the embodiments as described above is not restrictive but illustrative in all respects.

The invention claimed is:

1. A bed having a portion automatically movable and foldable, the bed comprising:

a body frame having a predefined height so as to support an upper body of a user;

a leg frame connected to one side of the body frame and configured to support a lower body of the user;

a plurality of foldable legs having upper ends pivotably connected to the leg frame;

an actuator operably connected to the plurality of foldable legs and configured to drive pivoting movement of the plurality of foldable legs between a folded position and an unfolded position;

a vertical movement guide disposed on one side of the body frame and extending in a vertical direction to guide vertical movement of the leg frame relative to the body frame;

a first guide roller connected to the leg frame and configured to move along the vertical movement guide;

a sliding guide rail disposed at each of left and right sides of a bottom portion of the body frame to guide horizontal movement of the leg frame; and a second guide roller disposed at one end of the leg frame corresponding to a position of the sliding guide rail, wherein of the second guide roller is guided along the sliding guide rail during horizontal movement of the leg frame, wherein the actuator is further configured to automatically move the leg frame vertically by folding the plurality of foldable legs.

2. The bed of claim 1, wherein the first guide roller is connected to and supported on the leg frame via a support bracket having a U shape, wherein the first guide roller is pivotably connected to the support bracket via a pivot shaft.

3. The bed of claim 1, wherein the plurality of foldable legs includes front two foldable legs and rear two foldable legs connected to each other via a connection frame at upper ends of the legs such that the front two foldable legs and the rear two foldable legs simultaneously pivot so as to be folded under an operation of the actuator.

4. The bed of claim 1, further comprising:

a shock absorbing pad disposed at an end of the sliding guide rail to absorb shock of the first guide roller when the leg frame is lowered, wherein the shock absorbing pad is elastically supported on a shock absorbing spring, wherein the shock absorbing spring is formed in a pad groove formed in the sliding guide rail.

5. The bed of claim 4, wherein the sliding guide rail is coated with a protective layer to reduce impact of the second guide roller when the leg frame is lowered down and to achieve smooth sliding movement, wherein the protective layer includes a mixture of polysulfone resin, sepiolite, epoxy vitrimer resin, potassium chromic acid, cobalt naphthenate phenylalanine, phenylalanine hydroxylase, polybenzimidazene, lithium hydroxide, isoflavonoid, polycaprolactone, and sodium fluoride.

* * * * *